US006279497B1

(12) United States Patent
Lovelady

(10) Patent No.: US 6,279,497 B1
(45) Date of Patent: Aug. 28, 2001

(54) METHOD OF MANUFACTURING TEXTURED CARPET PATTERNS AND IMPROVED TUFTING MACHINE CONFIGURATION

(75) Inventor: Brian K. Lovelady, Soddy-Daisy, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 09/429,465

(22) Filed: Oct. 28, 1999

Related U.S. Application Data

(60) Provisional application No. 60/106,236, filed on Oct. 29, 1998.

(51) Int. Cl.[7] ..... D05C 15/32; D05C 15/12

(52) U.S. Cl. ..... 112/80.54; 112/80.52

(58) Field of Search ..... 112/80.5, 80.52, 112/80.53, 80.54, 80.6, 80.4, 80.45, 80.32

(56) References Cited

U.S. PATENT DOCUMENTS

| | | | | |
|---|---|---|---|---|
| 3,019,748 | * | 2/1962 | Card | 112/80.52 X |
| 3,780,678 | * | 12/1973 | Short | 112/80.53 |
| 4,867,080 | * | 9/1989 | Taylor et al. | 112/80.32 |
| 4,993,336 | * | 2/1991 | Mizinuma | 112/80.45 X |
| 5,986,821 | * | 4/1999 | Neely et al. | 112/80.52 |

* cited by examiner

*Primary Examiner*—Ismael Izaguirre
(74) *Attorney, Agent, or Firm*—Miller & Martin

(57) ABSTRACT

A looper and needle configuration with lower set rear needles and corresponding loopers is provided to create more uniform low pile height yarns in a multiple pile height fabric. The tufting and tip shearing such fabrics will simulate woven fabrics.

16 Claims, 4 Drawing Sheets

METHOD OF MANUFACTURING TEXTURED CARPET PATTERNS AND IMPROVED TUFTING MACHINE CONFIGURATION

This application claims priority from U.S. Provisional Application Ser. No. 60/106,236 filed Oct. 29, 1998.

BACKGROUND OF THE INVENTION

This invention relates to an improved tufting machine configuration for the tufting of carpet with a relatively low pile and a relatively high pile with the relatively low pile areas being substantially more uniform than has heretofore been achieved. The resulting carpet is particularly well suited for tip shearing the relatively high pile sections.

The tufting of multiple pile height carpet patterns is well known in the tufting industry and has been accomplished through a variety of techniques, most generally pattern control yarn feed mechanisms of roll type or scroll type attachments. Most recently, such pattern attachments have been driven by computer controlled servo motors as described in Taylor, U.S. Pat. No. 4,867,080 and most preferably by independent servo motor controlled pattern attachments such as is described in the assignee's co-pending Ser. No. 08/980,045.

Traditionally, when tufting multiple pile height carpet, the yam carrying needles are set to penetrate backing fabric by an equal depth and to be seized upon loopers at an equal depth below that backing fabric. The difference in pile height is obtained by relatively underfeeding the yarns to the low pile height areas and thereby backrobbing some of the yam tufted for those stitches. Backrobbing is an inherently non-uniform process as it involves not only the elasticity of a particular section of yam, but also the varying resistance encountered by that yam as it is pulled through the backing fabric. The result is that slight variations in pile height occur and these variations are exaggerated the more the yam must be backrobbed to produce a low pile height. Such variations make it difficult to closely tip shear the relatively higher pile height yams without also tip shearing some of the irregular lower pile height yams. Thus a method of more uniformly tufting lower pile height yams is desired.

SUMMARY OF THE INVENTION

It is therefore an object of this invention to provide a multiple needle tufting machine with a pattern control yam feed mechanism and a method of more uniformly tufting low pile height yams in a multiple pile height yam pattern.

The preferred mechanism to accomplish this object is to shim the needles which tuft the relatively high pile height yams so that they penetrate the backing fabric to a greater depth than the needles tufting the relatively lower pile height yams and by similarly aligning the hooks which cooperate with the shimmed needles at a depth further beneath the backing fabric than the hooks operating with the needles tufting the relatively lower pile height yarns.

It is another object of this invention to provide an improved high/low tufted fabric.

It is yet another object of this invention to produce high/low tufted fabric with lower overall yam usage.

It is a further object of the invention to produce a high/low tufted fabric that can be closely tip sheared in a fashion that shears a very large percentage of the relatively higher tufted yams without shearing any substantial percentage of the lower tufted yams.

DETAILED DESCRIPTION OF THE DRAWINGS

Figure 1:
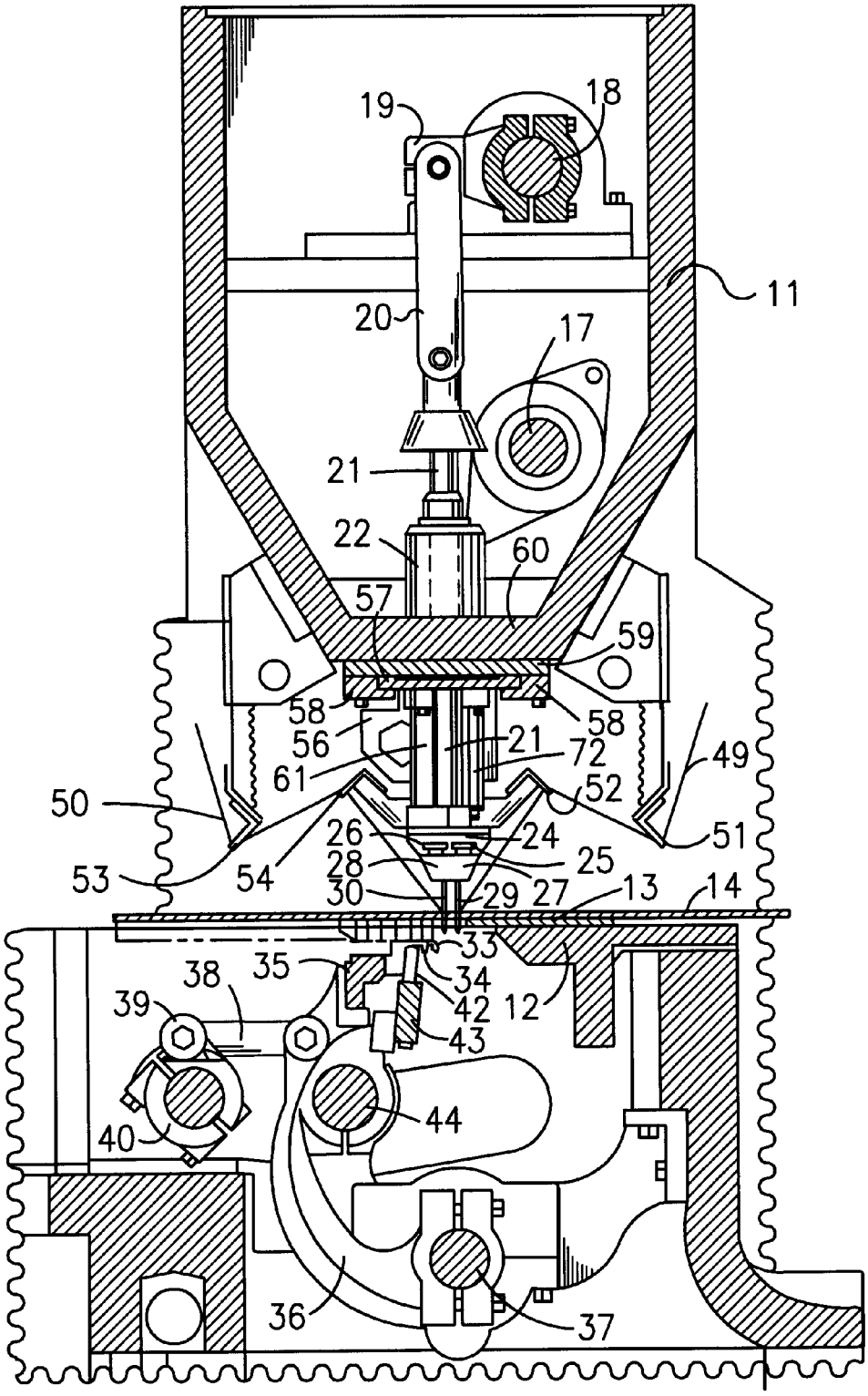
FIG. 1 is a fragmentary sectional elevation of a tufting machine configured to tuft cut pile fabrics.

Referring now to the drawings in more detail, FIG. 1 discloses a cross section of a tufting machine 10. The machine 10 includes the housing 11 and a bed frame 12 upon which is fixed needle plate 13 for supporting a base fabric 14 adapted to be moved through the machine 10 from front to rear in the direction of the arrow 15 by conventional fabric rollers, not shown.

A motor, not shown, drives a rotary main drive shaft 17, which is connected by linkage, not shown, for reciprocably moving a needle rocker shaft 18 carrying rocker arms 19 pivotally connected through link arms 20 to push rods 21 reciprocably supported in corresponding push rod housings 22.

The lower end of each push rod 21 is fixedly connected to an elongated needle bar slide holder or foot 24 having a pair of parallel slide ways for reciprocably and slidably receiving slides 25 and 26 of substantially T-shaped or circular cross section. Each slide 25 and 26 is fixed to a respective front needle bar 27 and rear needle bar 28. The front needle bar 27 supports the plurality of uniformly spaced first or front needles 29 preferably aligned along the longitudinal axis of the needle bar 27. Rear needle bar 28 supports the plurality of uniformly spaced second or rear needles 30 also preferably aligned along the longitudinal axis of the rear needle bar 28.

The looper mechanism 32, disclosed in FIG. 1, is of a known construction, such as that disclosed in U.S. Pat. No. 4,003,321 for cut pile apparatus for staggered needle tufting machine. The looper mechanism 32 includes a plurality of alternate first and second cut pile hooks 33 and 34, each first cut pile hook 33 having either a longer or more forward positioned bill than each of the second cut pile hooks 34. The throats of the cut pile hooks 33 and 34 are all longitudinally aligned transversely of the feeding direction 15. Each first cut pile hook 33 is adapted to cooperate with a first or front needle 29, while each second cut pile hook 34 is adapted to cooperate with a second or rear needle 30.

The elongated cut pile hook bar 35, extending the width of the machine 10, is mounted on rocker arms 36, the lower ends of which are connected for rotary movement upon the looper shaft. The rocker arms 36 are pivotally connected through link arms 38 to rocker arms 39 fixed to a reciprocable jack shaft 40, in turn connected to appropriate linkage to the main shaft 17, in a conventional manner, for a reciprocable movement.

Each of the cut pile hooks 33 and 34 cooperates with the knife 42 fixed in a knife holder 43, in turn supported upon the reciprocable knife shaft 44, also connected by linkage, not shown, to operate in timed relationship with the looper jack shaft 40, so that the knives 42 cooperate with the throats of the respective hooks 33 and 34 for severing yarn loops caught upon the bills of the hooks 33 and 34 to produce the cut pile tufts 46. All of the knives 42 are longitudinally aligned transversely of the machine 10 as described in the above U.S. Pat. No. 4,003,321.

It is also within the scope of this invention to replace the cut pile looper mechanism 32 with a loop pile looper mechanism in order to produce loop pile instead of cut pile if desired. It is well known that loop pile looper mechanisms have rearward facing loopers with respect to the yam feed direction 15 as illustrated by first loopers 33*a* and second loopers 34*a* in FIGS. 2 and 3, rather than forward facing loopers 33, 34 shown in FIG. 1 to create a cut pile fabric.

Since there are two needle bars 27 and 28 supporting a front row of needles 29 and a rear row of needles 30, respectively, on a relatively narrow needle gauge, the needles extending the full width of the machine, two separate yam supplies must be provided, one located on the front of the machine housing 11 and the other on the rear side of the machine housing 11 in order to supply the first or front yams 49 to the front needles 29 and the second or rear yams 50 to the rear needles 30. The yams 49 and 50 may be fed by any conventional means such as yam feed rolls, not shown, mounted on front and rear of the machine housing 11, respectively, from yam supplies, such as yam creels, also not shown. The yams 49 are fed through corresponding yam holes in a yam guide 51 and a front yam jerker 52 to the corresponding front needles 29 in a conventional manner. In a like manner, the rear yams 50 are fed through thread holes in the rear yam guide 53 and rear yam jerker 54 to the corresponding rear needles 30.

Each of the needle bars 27 and 28 may be independently controlled and actuated to shift longitudinally of its own axis transversely of the machine 10. However, independent shifting of needle bars is not required as when utilizing servo motor controlled scroll type pattern attachments such as described in Ser. No. 08/980,045, the necessary placement of high and low yams may be made solely through the use of controlling the yam fed to the respective needles.

In order to tuft a relatively high pile height carpet, it is necessary to raise the needle plate 13 with respect to the position of the loopers 33 and 34. Therefore, if it is desired to produce a carpet with a high pile height of as much as ½", it is customary that the loopers 33 and 34 be spaced slightly more than ½" beneath the backing fabric 14 resting on needle plate 13. The needle plate 13 should be adjustable to create fabrics with different pile heights. This setting permits the tufting of stitches slightly more than ½" in height, and when a small amount of yarn is backrobbed from the next stitch the tuft will still maintain a stitch height of ½". If in the same pattern it is desired to sew some stitches at a height of only ¼", the yarn for those stitches must be underfed so that a substantial portion of the tufted yarn is pulled back through the backing fabric and the resulted tufted pile is much shorter. The backrobbing of yarn from previous stitches is a somewhat irregular process due to characteristics of the yarn, the loopers, and the backing fabric. Accordingly, the greater distance the yarn is backrobbed, the less uniformity can be maintained in the height of those stitches. In fact, if a substantial amount of yam is backrobbed in order to create a relatively low pile height stitch such as one/sixteenth of an inch in height, it will be expected that some of the stitches may even pull through the backing fabric in the backrobbing process and create obvious irregularities in the carpet surface.

Figure 3:
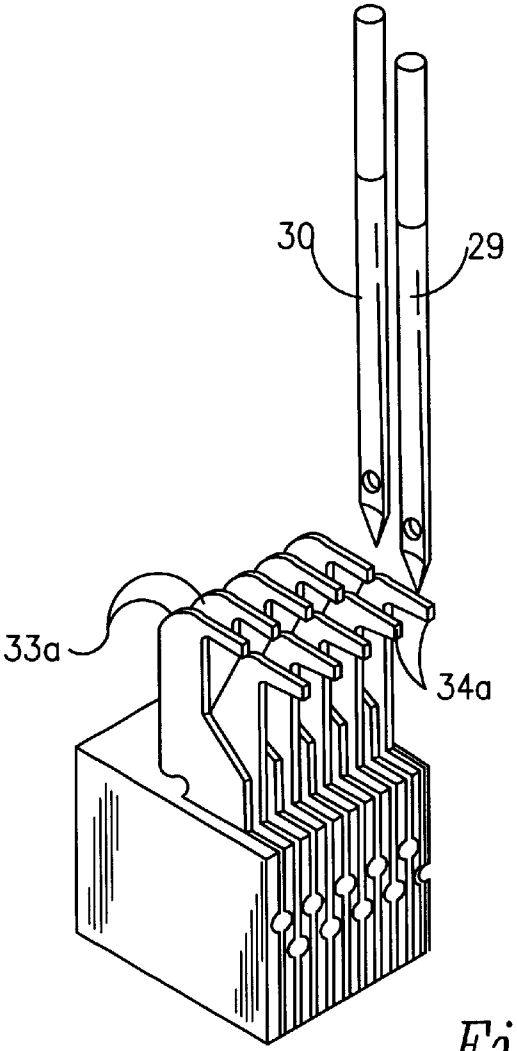
FIG. 3 is a perspective view of the needles and loopers shown in FIG. 2.
Figure 2:
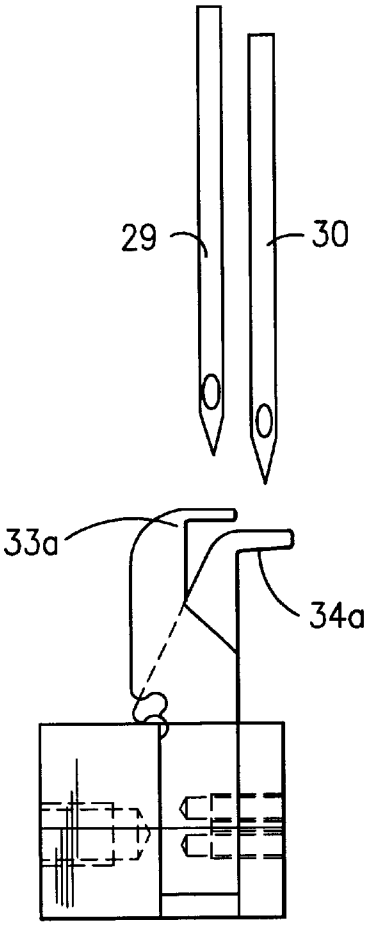
FIG. 2 is an enlarged fragmentary section showing the preferred configuration of needles and loopers to create a loop pile fabric according to the present invention.

The instant invention, which is now believed most suitable for use in creating loop pile carpet utilizing the configuration shown in FIGS. 2 and 3, tufts relatively low pile height loops with yarns tufted with front needles 29 and a relatively higher pile height on yams tufted with rear needles 30. In the preferred configuration, the rear needles 30 with used to tuft the higher pile height yarn are shimmed so that they penetrate the backing fabric to a greater depth. The corresponding loopers 33*a* for shallower penetrating front needles 29 are spaced forward and upward of second loopers 34*a* which cooperate with a shimmed or deeper set rear needles 30. The distance of the offset between the front 29 and rear needles 30 should correspond to the upward distance offset between the first loopers 33*a* and second loopers 34*a*. In order to achieve the benefits of the invention, this offset distance should be at least 0.125".

Figure 4:
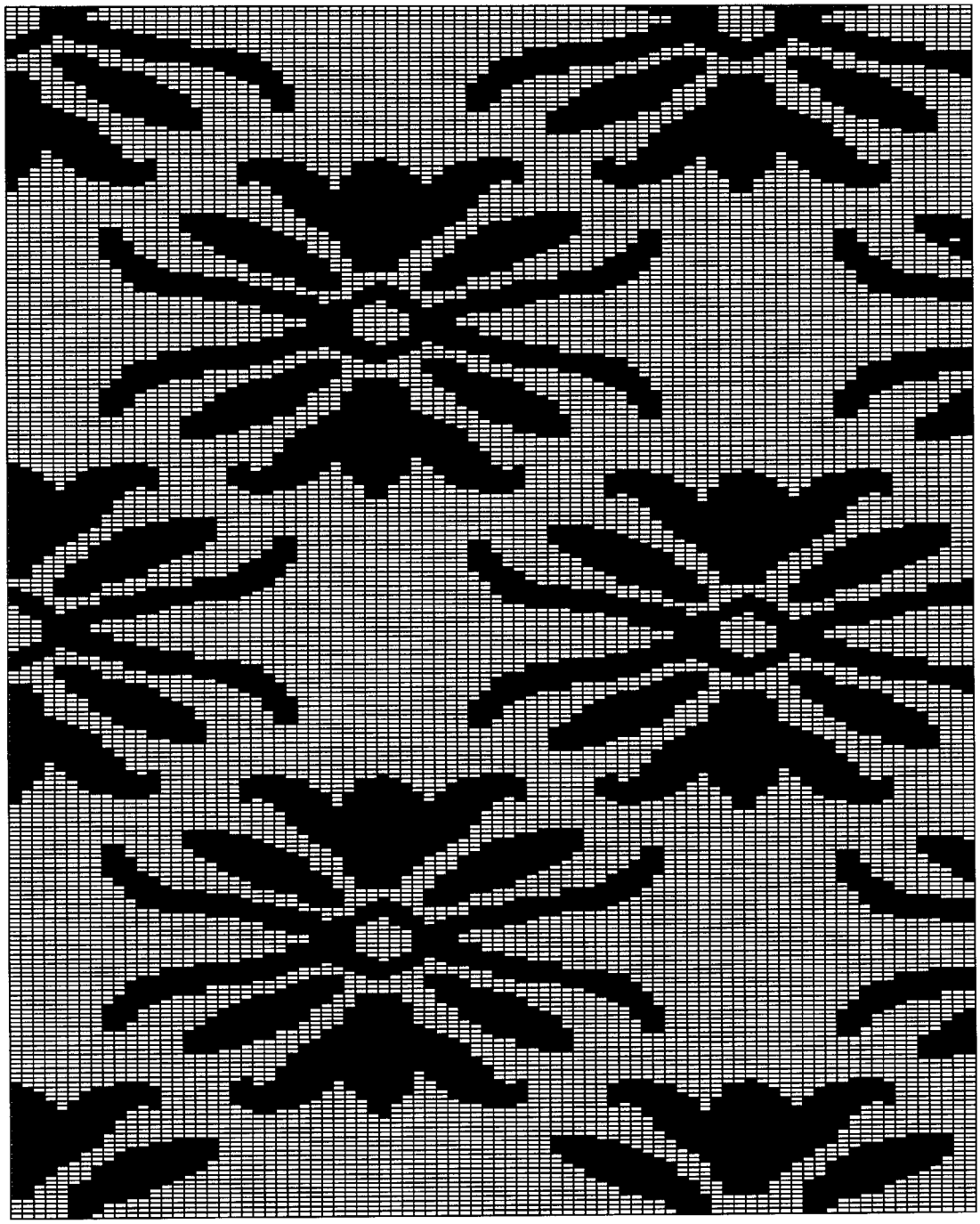
FIG. 4 is an illustration of a representative fabric pattern that may be tufted utilizing the present invention with the white yams preferably being tufted at relatively lower heights than the black yams.

Utilizing this configuration, front needles 29 may be threaded with white yarns 49 and tufted at a relatively low pile height such as 3/16ths of an inch. In such a case, the first loopers may be spaced only about 4/16ths of an inch beneath the backing fabric 14 such that minimal backrobbing is required to obtain the relatively low pile height stitches with yarn 49. On the other hand, rear yarns 50 will be tufted over second loopers 34*a* which are spaced at least 6/16ths of an inch beneath the backing fabric 14. If the rear yams 50 are fed sufficiently to produce only minimal backrobbing in the black areas of the pattern according to FIG. 4, the pile height in those areas will be at least ⅛t of an inch higher than the lower pile height areas and the low pile height areas will be substantially uniform in height. It should be noted that the present invention may also utilize pattern control yarn feed attachments to create varied stitch heights. As illustrated by the carpet pattern of FIG. 4, needles may be fed yarn such that minimal backrobbing occurs creating a relatively low pile height such as 3/16ths of an inch, creating the light colored areas, and other selected front needles may be fed at lower rates to cause significant backrobbing creating a pile height significantly lower than 3/16ths of an inch. This creates buried loops, the color of the buried yarn loops is masked by the surrounding relatively high pile stitches of rear yarns as represented in the darker areas of FIG. 4. This permits the effective tip shearing of the high pile height black pattern areas at a height only very slightly greater than the height of the first yarn 49 low pile loops and thereby a tip sheared fabric of heretofore unattained uniformity of height. Even without tip shearing, it is possible to create a multiple pile height tufted carpet with more uniform low pile tufts than has heretofore been achieved. Due to the uniformity in the lower pile height, it is possible to tuft the low pile height at a lower height and thereby correspondingly reduce the amount of yarn required for the fabric.

Figure 5:
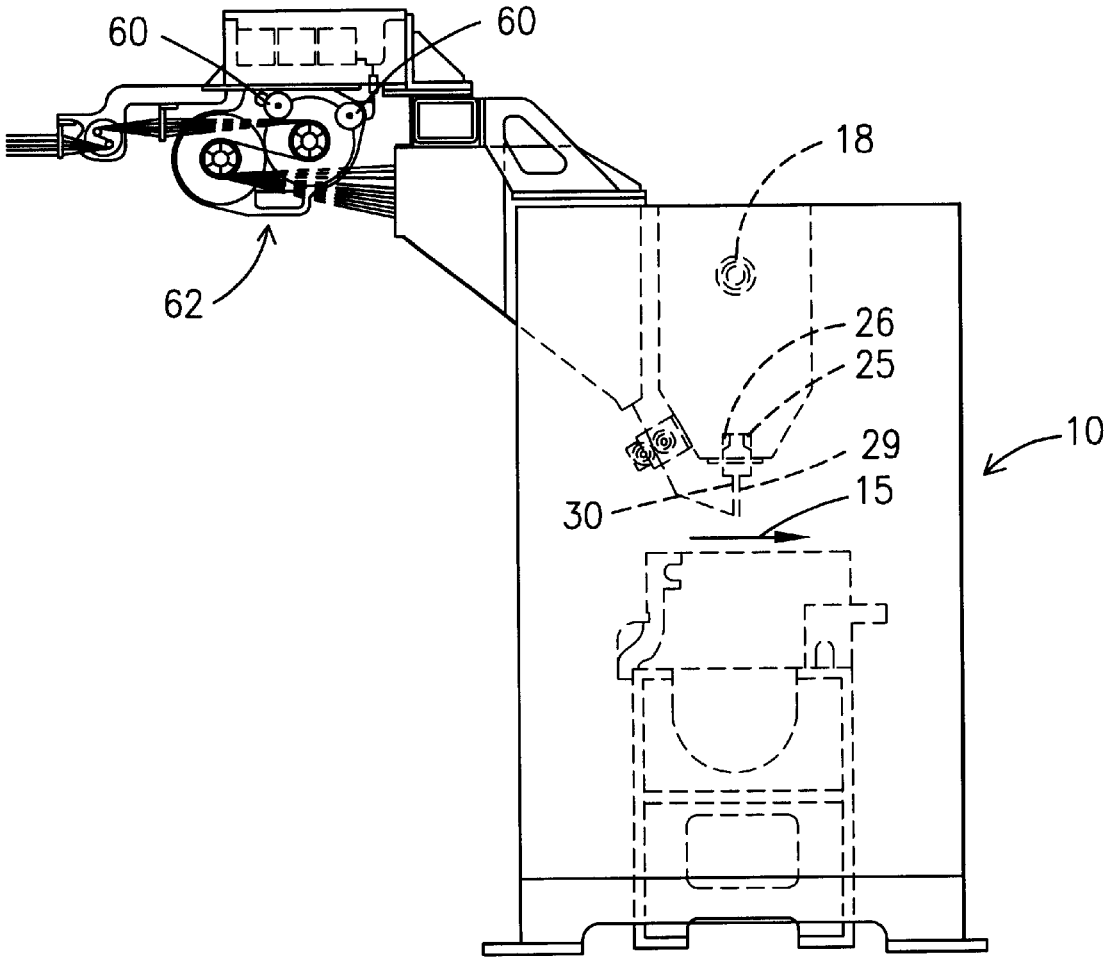
FIG. 5 is a side elevation of a multiple needle tufting machine having a servo driven yam feed mechanism in accordance with the invention.

It will be understood that in order to achieve the most desirable patterns, servo controlled yarn feeds 62, with independent servo motors 60, as shown in FIG. 5, are preferred because clutch driven yarn feeds will not create as crisp a height differentiation between the low pile height and high pile height stitches. This results in the inability of the tip shearing to cut as high a percentage as the high pile height loops and produces a less attractive appearance. However, in the event the resulting high/low carpet is not to be tip sheared, the needle and looper configuration of the present invention will still produce improved uniformity of stitch pile height, especially for the low pile height stitches, even with a clutch driver attachment.

While the invention has been described in terms of its preferred embodiments, numerous alterations of the products and methods herein described will suggest themselves to those skilled in the art. It will be understood that the details and arrangements of the embodiments that have been described and illustrated in order to explain the nature of the invention are not to be construed as any limitation of the invention, and all such alterations which do not depart from the spirit of invention are intended to be included within the scope of the appended claims.

What is claimed:

1. In a tufting machine having a backing fabric support, a means for feeding backing fabric longitudinally through the machine, a needle bar supporting a plurality of needles transversely of the machine on a first side of the backing fabric, a yarn supply means for feeding yarns to the needles, a means for reciprocating the needle bar to drive the needles into and out of the backing fabric upon the backing fabric support and a plurality of loopers transversely of the machine on a second opposite side of the backing fabric for seizing loops of yarn from the needles penetrating the backing fabric, a sewing configuration comprising:

(a) a forward row of needles uniformly spaced transversely of the feeding direction, and a rear row of needles uniformly spaced transversely of the feeding direction, the rear row of needles being positioned to penetrate the backing fabric to a depth of at least about 0.125 inches more than the forward row of needles;

(b) a forward row of loopers disposed transversely to the feeding direction for seizing yarns from the forward row of needles and a rear row of loopers disposed transversely to the feeding direction for seizing yarns from the rear row of needles, wherein the forward row of loopers is spaced upward of the rear row of loopers by a distance substantially equal to the difference in depth between the first row of needles and the second row of needles.

2. The tufting machine according to claim 1 further comprising a cutting apparatus for cutting loops of yarn seized upon the loopers.

3. The tufting machine according to claim 1 in which the yarn supply means are servo controlled.

4. In a tufting machine having a backing fabric support, a means for feeding backing fabric longitudinally through the machine, a needle bar supporting a plurality of needles transversely of the machine on a first side of the backing fabric, a yarn supply means for feeding yarns to the needles, a means for reciprocating the needle bar to drive the needles into and out of the backing fabric upon the backing fabric support and a plurality of loopers transversely of the machine on a second opposite side of the backing fabric for seizing loops of yarn from the needles penetrating the backing fabric, a sewing configuration comprising:

(a) a forward row of needles uniformly spaced transversely of the feeding direction and a rear row of needles uniformly spaced transversely of the feeding direction;

(b) a forward row of loopers disposed transversely to the feeding direction for seizing yarns from the forward row of needles and a rear row of loopers disposed transversely to the feeding direction for seizing yarns from the rear row of needles, the forward row of loopers spaced forward and upward by at least about 0.125 inches more than the rear row of loopers, wherein the the rear row of needles is positioned to penetrate the backing fabric, to a greater depth than the forward row of needles by a distance substantially equal to the difference in spacing between the first and second row of loopers.

5. The tufting machine according to claim 4 further comprising a cutting apparatus for cutting loops of yarn seized upon the loopers.

6. The tufting machine according, to claim 4 in which the yarn supply means are servo controlled.

7. A method of manufacturing textured carpet patterns utilizing a tufting machine having a yarn supply and two rows of transversely aligned needles with corresponding rows of loopers to form a textured carpet pattern with a relatively low pile and a relatively high pile with the relatively low pile being substantially uniform in height and the relatively high pile sections being well suited for tip shearing comprising the steps of:

(a) spacing a rear row of needles to penetrate a backing fabric to a greater depth than a forward row of needles;

(b) threading the forward row of needles with first yarns from the yarn supply;

(c) threading the rear row of needles with second yarns from the yarn supply;

(d) spacing a first row of loopers to a depth beneath the backing fabric of about 1/16 inch greater than the relatively low pile height;

(e) spacing a second row of loopers to a depth beneath the backing fabric of at least about 3/16 inch greater than the relatively low pile height;

(f) moving backing fabric longitudinally through the tufting machine in a feeding direction;

(g) feeding selected needles in the first row of needles with the first yarns to produce first relatively low pile height loops with minimal backrobbing and feeding other selected needles in the first row of needles with first yarns and backrobbing to produce buried loops;

(h) feeding selected needles in the second row of needles with second yarns with minimal backrobbing to produce second relatively high pile height loops, such that the resulting second relatively high pile height loops are at least about 1/8 inch higher than the first relatively low pile height loops;

(i) tip shearing the second pile loops to a height about the height of the first relatively low pile loops.

8. The method of claim 7 wherein the yarn supply is controlled by a servo motor.

9. method of manufacturing textured carpet patterns utilizing a tufting machine having a yarn supply and two rows of transversely aligned needles with corresponding rows of loopers to form a textured carpet pattern with a relatively low pile and a relatively high pile with the relatively low pile being substantially uniform in height and the relatively high pile sections being well suited for tip shearing comprising the steps of:

(a) spacing a rear row of needles to penetrate a backing fabric to a greater depth than a forward row of needles;

(b) threading the forward row of needles with first yarns from the yarn supply;

(c) threading the rear row of needles with second yarns from the yarn supply;

(d) spacing a first row of loopers to a depth beneath the backing fabric of about 1/16 inch greater than the relatively low pile height;

(e) spacing a second row of loopers to a depth beneath the backing fabric of at least about 3/16 inch greater than the relatively low pile height;

(f) moving backing fabric longitudinally through the tufting machine in a feeding direction;

(g) feeding selected needles in the first row of needles with the first yarns to produce first relatively low pile height loops with minimal backrobbing and feeding other selected needles in the first row of needles with first yarns and backrobbing to produce buried loops;

(h) feeding selected needles in the second row of needles with second yarns with minimal backrobbing to produce second relatively high pile height loops, such that the resulting second relatively high pile height loops are at least about 1/8 inch higher than the first relatively low pile height loops;

(i) tip shearing the second pile loops to a height about the height of the first relatively low pile loops;

wherein the spacing between the front and rear needles correspond to the spacing between the first and second loopers.

10. The method of claim 7 wherein the relatively low pile height is between about 1/16 and 1/4 inch.

11. The method of claim 7 wherein other selected needles in the second row of needles are fed with second yarns and backrobbed to produce loops shorter than the relatively high pile height loops.

12. A method of manufacturing textured carpet patterns utilizing a tufting machine having a yarn supply and two rows of transversely aligned needles with corresponding rows of loopers to form a textured carpet pattern with a relatively low pile comprising the steps of:

(a) spacing a rear row of needles to penetrate a backing fabric to a greater depth than a forward row of needles;

(b) threading the forward row of needles with first yarns from the yarn supply;

(c) threading the rear row of needles with second yarns from the yarn supply;

(d) spacing a first row of loopers to a depth beneath the backing fabric of about 1/16 inch greater than the relatively low pile height;

(e) spacing a second row of loopers to a depth beneath the backing fabric of at least about 3/16 inch greater than the relatively low pile height;

(f) moving backing fabric longitudinally through the tufting machine in a feeding direction;

(g) feeding selected needles in the first row of needles with the first yarns to produce first relatively low pile height loops with minimal backrobbing and feeding other selected needles in the first row of needles with first yarns and backrobbing to produce buried loops; and (h) feeding selected needles in the second row of needles with second yarns with to produce second pile loops, such that the resulting second pile loops are at least higher than the buried loops.

13. The method of claim 12 wherein the yarn supply is controlled by a servo motor.

14. The method of claim 12 wherein the spacing between the front and rear needles correspond to the spacing between the first and second loopers.

15. The method of claim 12 wherein the relatively low pile height is between about 1/16 and 1/4 inch.

16. The method of claim 12 wherein other selected needles in the second row of needles are fed with second yarns and backrobbed to produce loops shorter than the relatively high pile height loops.

* * * * *